United States Patent [19]

Oba et al.

[11] Patent Number: 4,681,422

[45] Date of Patent: Jul. 21, 1987

[54] PAPER SUPPLY DEVICE FOR AN ELECTROSTATIC PHOTOGRAPHIC PRINTER

[75] Inventors: Harutaro Oba; Yasuhiko Ozawa; Yasuyoshi Yamaguchi, all of Shizuoka; Osamu Mimoto, Kanagawa, all of Japan

[73] Assignee: Tokyo Electric Co., Ltd., Tokyo, Japan

[21] Appl. No.: 791,433

[22] Filed: Oct. 25, 1985

[30] Foreign Application Priority Data

Nov. 1, 1984 [JP] Japan ..... 59-230773
Nov. 8, 1984 [JP] Japan ..... 59-236494
Nov. 12, 1984 [JP] Japan ..... 59-237968

[51] Int. Cl.[4] ..... G03G 15/00
[52] U.S. Cl. ..... 355/3 R; 355/3 SH
[58] Field of Search ..... 355/3 SH, 14 SH, 3 R, 355/3 DR, 8

[56] References Cited

U.S. PATENT DOCUMENTS

| | | | |
|---|---|---|---|
| 3,600,082 | 8/1971 | Knechtel | 355/8 |
| 3,770,345 | 11/1973 | Kawakubo et al. | 355/3 DR |
| 3,966,316 | 6/1976 | Pfeifer | 355/3 R |
| 4,376,577 | 3/1983 | Okamoto | 355/3 DR |
| 4,376,579 | 3/1983 | Wakao | 355/3 DR |
| 4,386,841 | 7/1983 | Wakao | 355/3 DR |
| 4,403,851 | 9/1983 | Yanagawa | 355/14 R |
| 4,412,734 | 11/1983 | Shibuya | 355/3 SH |
| 4,416,536 | 11/1983 | Itoh | 355/14 R |

FOREIGN PATENT DOCUMENTS

| | | | |
|---|---|---|---|
| 3404438 | 8/1984 | Fed. Rep. of Germany . | |
| 58-147758 | 9/1983 | Japan | 355/14 SH |
| 1280242 | 7/1972 | United Kingdom . | |

*Primary Examiner*—Arthur T. Grimley
*Assistant Examiner*—J. Pendegrass
*Attorney, Agent, or Firm*—Oblon, Fisher, Spivak, McClelland & Maier

[57] ABSTRACT

A paper supply device for an electrostatic photographic printer which can significantly reduce the area for installation of the printer. A housing of the printer includes a base and a cover connected for pivotal motion in a vertical plane relative to each other. A picture image forming means including a photosensitive member and so on is mounted on the base. A paper supply cassette is mounted on the cover. Paper is drawn out from the paper supply cassette by means of a paper supply roller and then guided to the picture image forming means by a paper guide which includes a guide plate mounted on the cover and another guide plate mounted on the base and disposed in opposing relationship to the guide plate on the cover. A gear wheel connected to the paper supply roll is meshed, when the cover is closed, with another driving gear wheel mounted on the base and connected to a motor. An engaging member is also provided on the cover and urged to engage with and hold the paper supply cassette from dropping off the cover.

5 Claims, 11 Drawing Figures

PAPER SUPPLY DEVICE FOR AN ELECTROSTATIC PHOTOGRAPHIC PRINTER

FIELD OF THE INVENTION

This invention relates to a paper supply device for an electrostatic photographic printer.

BACKGROUND OF THE INVENTION

In conventional techniques of supplying paper in electrostatic photographic printers, a paper supply cassette is normally used which is mounted on a side face of a housing of a printer.

Accordingly, it is a drawback of such conventional paper supply techniques that a paper supply cassette extends very long from a side of a housing, and hence a large area is requred for installation of a printer. Although there is another type wherein a paper supply cassette is disposed at a lower part of a housing, since a distance in a vertical direction from a transfer station to the paper supply cassette is small, a sheet of paper drawn out from the paper supply cassette must be turned into a U-shape of a relatively smaller radius of curvature. Accordingly, it is a problem that it is difficult to advance paper straightforwards between a photosensitive member and the transfer station, resulting in trouble in printing.

OBJECT OF THE INVENTION

The present invention has been made in consideration of such circumstances as described above, and it is an object of the invention to provide a paper supply device for an electrostatic photographic printer which can significantly reduce an area for installation of the printer.

SUMMARY OF THE INVENTION

According to the invention, a paper supply cassette 20 and a paper supply roller 22 are located at an upper part of a housing 1, and a sheet of paper 33 drawn out from the paper supply cassette 20 is transported to a transfer means 11 by a transporting means 18 under the guidance of a paper guide 27.

The housing 1 includes a base 2 and a cover 3 pivotally connected to the base 2. The paper supply cassette 20 and the paper supply roller 22 are provided on the cover 3.

The paper guide 27 includes a guide plate 25 provided on the base 2. Another guide plate 24 is provided on the cover 3 in an opposing relationship to the guide late 25.

An engaging member 29 is provided on the cover 3 and adapted to engage with the paper supply cassette 20.

A switch 31 is provided on the cover 3 and is operable in interlocking relationship with the engaging member 29.

Accordingly, the area of a floor occupied by a printer can be significantly reduced by disposing the paper supply cassette at an upper part of the housing 1. Besides, by forming the housing 1 from the base 2 and the cover 3 pivotally connected to the base 2 so as to allow the cover 3 to be opened, inspection can be facilitated. Moreover, by forming the paper guide 27 from the guide plate 25 provided on the base 2 and the guide plate 24 provided on the cover 3 in an opposing relationship to the guide plate 25 so as to allow the cover 3 to be opened to allow the paper guide 27 to open, operation to release jamming can be facilitated. Further, since the paper cassette 20 can be held by the engaging member 29, slipping out of the paper supply cassette 20 upon opening of the engaging member 29 can be prevented. In addition, since the switch 31 operates in response to the engaging member 29 which is displaced when the paper supply cassette 20 is empty, a signal representing the fact that a paper supply cassette 20 is not yet loaded can be obtained.

DETAILED DESCRIPTON OF THE PREFERRED EMBODIMENTS

Figure 1:
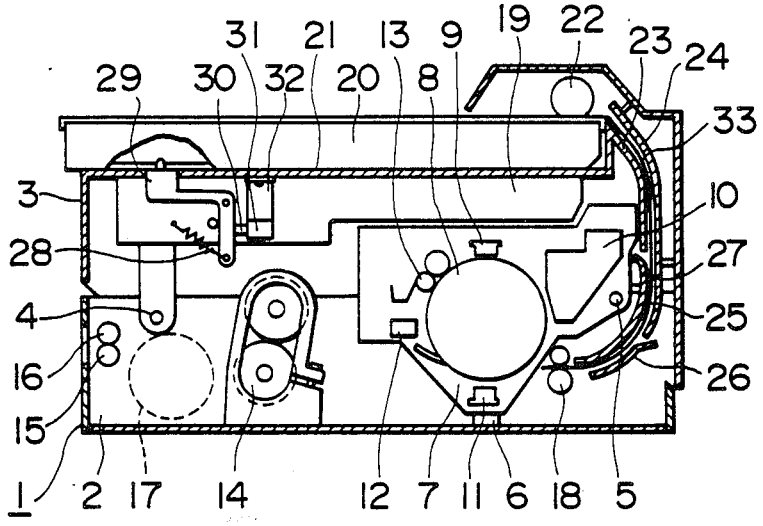
FIG. 1 is a vertical sectional side elevational view illustrating a first embodiment of paper supply device for an electrostatic photographic printer, in a printing condition, according to the present invention.
Figure 2:
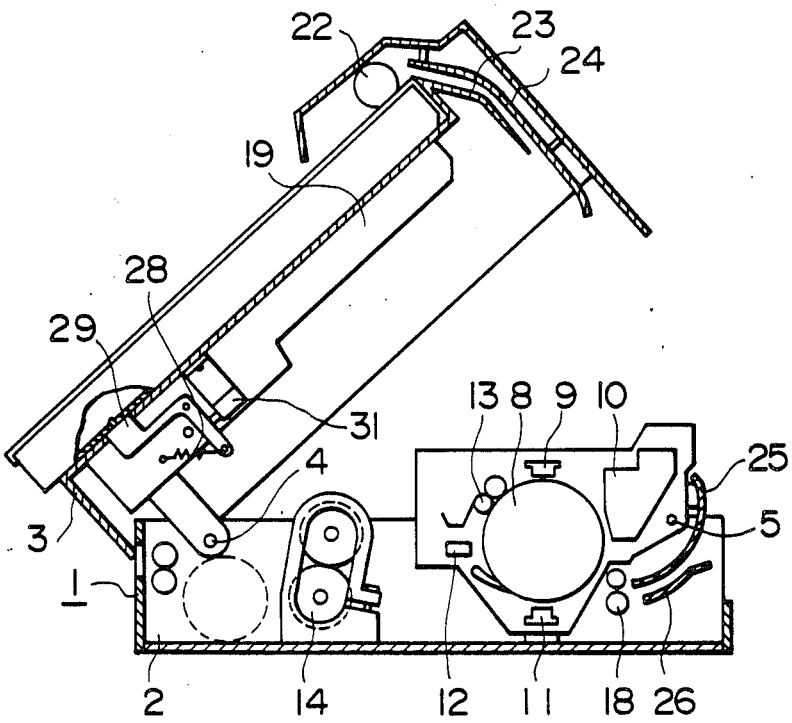
FIG. 2 is a vertical sectional side elevational view illustrating the device having a cover in an open position.
Figure 3:
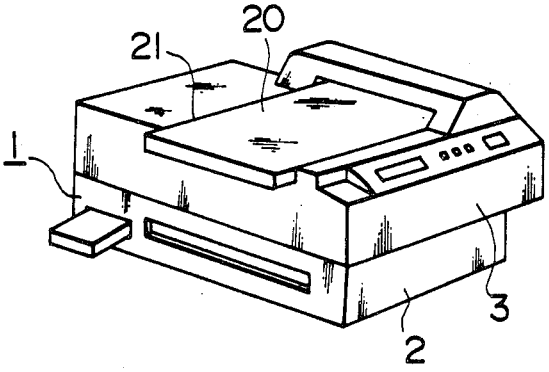
FIG. 3 is a perspective view, on a reduced scale, illustrating the entire printer.
Figure 4:
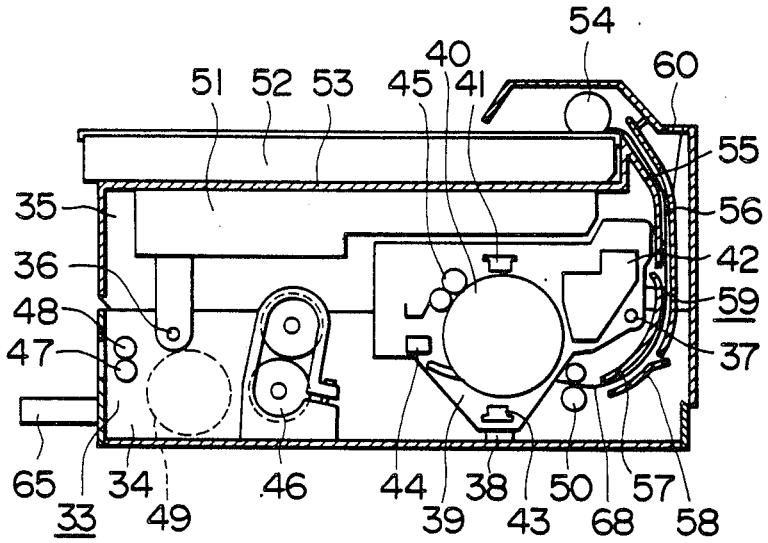
FIG. 4 is a vertical sectional side elevational view illustrating a second embodiment of paper supply device for an electrostatic photographic printer according to the invention.

A first embodiment of the present invention will now be described in detail with reference to FIGS. 1 to 3. A housing 1 includes a base 2 in the form of a box which is open at the top thereof, and a cover 3 in the form of a box which is open at the bottom thereof and connected at an end thereof for pivotal motion to the base 2 by means of a pivot shaft 4. The cover 3 is removably connected at the other end thereof to the base 2 by means of a clamp not shown. The base 2 has a drum frame 7 mounted for pivotal motion around a pivot shaft 5 thereon. The drum frame 7 is urged to pivot downwardly by its own weight to a position in which it is abutted against and positioned by a stop 6.

A cylindrical photosensitive member 8 is supported for pivotal motion at a portion of the base 2 (that is, on the drum frame 7.) and is connected to a motor (not shown). A charging means 9, a tone supplying means 10, a transfer means 11, a lamp 12, and a cleaning means 13 are located in order around an outer periphery of the photosensitive member 8. The base 2 has provided thereon a fixing roller 14 serving as a fixing means, a discharging roller 15, a pressure roller 16 contacted under pressure with the discharging roller 15, a motor 17 for driving the discharging roller 15 and the fixing roller 14, and a paper feeding means 18.

A light source means 19 for illuminating a laser beam to the photosensitve member 8 to effect optical scanning is mounted on a rear face of a top wall of the cover 3, and a recess 21 for slidably holding a paper supply cassette 20 is formed in the cover 3 in an opposing relationship to the light source means 19. A paper supply roller 22 is located in the interior of the recess 21 and is connected to a motor (not shown). The cover 3 has provided at a side portion thereof a guide plate 23 which depends from an end of the recess 21 and another guide plate 24 which is longer than the guide plate 23. The base 2 has provided thereon a further guide plate 25 which is held on the drum frame 7 in an opposing relationship to a lower part of the guide plate 24. A still further guide plate 26 is opposed to a lower part of the guide plate 25. Thus, the guide plates 23 to 26 cooperatively constitute a paper guide 27.

An engaging member 29 is mounted for pivotal motion at an upper part of the cover 3 and is urged into engagement with a small hole formed in the bottom of the paper supply cassette 20 by a spring 28. A switch 31 is mounted on the cover 3 by means of a bracket 32. The switch 31 an actuator 30 located for contact with the engaging member 29.

In the printer having such a construction as described above, as the photosensitive member 8 is rotated one complete rotation, a layer of charge is first formed on an outer periphery of the photosensitive member 8 by the charging means 9, and then a laser beam is scanned from the light source means 19 to the layer of charge to form an electrostatic latent image on the photosensitive member 8. Then, toner is supplied from the toner supplying means 10 to the photosensitive member 8 to convert the electrostatic latent image into a visible toner image. Meanwhile, a sheet of paper 33 drawn out from the paper supply cassette 20 by the paper supply roller 22 is guided by the paper guide 27 and fed by the paper feeding means 18 to a position below the photosensitive member 8. At that position the visible toner image on the photosensitive member 8 is transferred to the sheet of paper 33 by the transfer means 11 and is then fixed thereto by the fixing roller 14. The sheet of paper 33 is finally discharged outside the printer by the discharging roller 15 and the pressure roller 16.

After transfer of the toner image, the electrostatic latent image remaining on the photosensitive member 8 is then exposed to and thus erased by light from the lamp 12. Thereafter toner remaining on the photosensitive member 8 is scraped off by the cleaning means 13.

Since the paper supply cassette 20 is provided on the top of the cover 3 in this way, the area required for installation of the printer can be reduced significantly. Besides, since the cover 3 can be pivotally opened around the pivot shaft 4, and since the drum frame 7 can also be pivotally opened around the pivot shaft 5, inspection and operation to release jamming can be effected easily. In addition, since the guide plate 24 normally opposed to the guide plate 25 is lifted when the cover 3 is opened, even if a sheet of paper 33 jams within the paper guide 27, it can be easily removed by partly opening the paper guide 27.

Moreover, since the paper supply cassette 20 is held by the engaging member 29 even if the cover 3 is opened, it cannot slip out to drop therefrom. If the paper supply cassette 20 is unloaded from the printer, the engaging member 29 is pivoted in a clockwise direction (in FIGS. 1 and 2) and operates the switch 31 so that the switch 31 delivers a signal. By this signal, an unloaded condition of the paper supply cassette 20 can be announced.

As described so far, since according to the present invention a paper supply cassette is located at an upper part of a housing, the area for installation of the printer can be reduced significantly. Further, since the housing is constituted from a cover and a base, operation for inspection, operation to release jamming, and like operations can be effected easily by opening the cover. Further, since a paper guide is constituted from a guide plate provided on the base and another guide plate provided on the cover in an opposing relationship to the guide plate on the base, paper jammed in the paper guide can be easily removed therefrom by opening the cover and then the paper guide. Besides, when the cover is opened, slipping out of the paper supply cassette can be prevented by an engaging member. Additionally, the invention presents a further effect that absence of a paper supply cassette can be announced, since a switch is provided which operates in response to an action of the engaging member.

A second embodiment of the present invention will now be described in detail with reference to FIGS. 4 to 7. A housing 33' includes a base 34 in the form of a box which is open at the top thereof, and a cover 35 in the form of a box which is open at the bottom thereof and connected at an end thereof for pivotal motion to the base 34 by means of a pivot shaft 36. The cover 35 is removably connected at the other end thereof to the base 34 by means of a clamp not shown. The base 34 has a drum frame 39 seving as a frame and mounted for pivotal motion around a pivot shaft 37 thereon. The drum frame 39 is urged to pivot downwardly by its own weight to a position in which it is abutted and positioned by a stop 38.

A cylindrical photosensitive member 40 is supported for povital motion on the drum frame 39 and is connected to a motor (not shown). A charging means 41, a developing means 42, a transfer means 43, a lamp 44, and a cleaning means 45 are located in order around an outer periphery of the photosensitve member 40. The base 34 has provided thereon a fixing roller 46 serving as a fixing means, a discharging roller 47, a pressure roller 48 contacted under pressure with the discharging roller 47, a motor 49 for driving the discharging roller 47 and the fixing roller 46, and a paper feeding means 50.

A light source means 51 for illuminating a laser beam to the photosensitive member 40 to effect optical scanning is mounted on a rear face of a top wall of the cover 35, and a recess 53 for slidably holding a paper supply cassette 52 is formed in the cover 35 in an opposing relationship to the light source means 51. A paper supply roller 54 is located in the interior of the recess 53 and is connected to a motor (not shown). The cover 35 has provided at a side portion thereof a guide plate 55 which depends froman end of the recess 53 and another guide plate 56 which is longer than the guide plate 55. The drum frame 39 has provided thereon a further guide plate 57 which is opposed to a lower part of the guide plate 56, and the base 34 has provided thereon a still further guide plate 58 which is opposed to a lower part of the guide plate 57. Thus, the guide plates 55 to 58 cooperatively constitute a paper guide 59. An opening 60 for manual insertion is formed in a right side wall of the cover 35.

Figure 5:
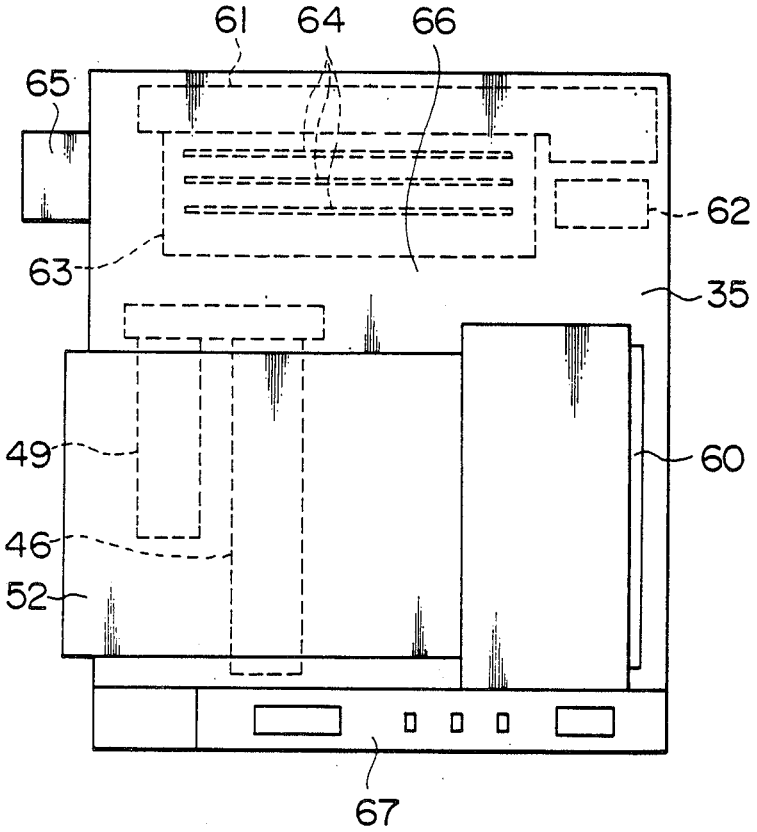
FIG. 5 is a plan view of the paper supply device of FIG. 4.
Figure 6:
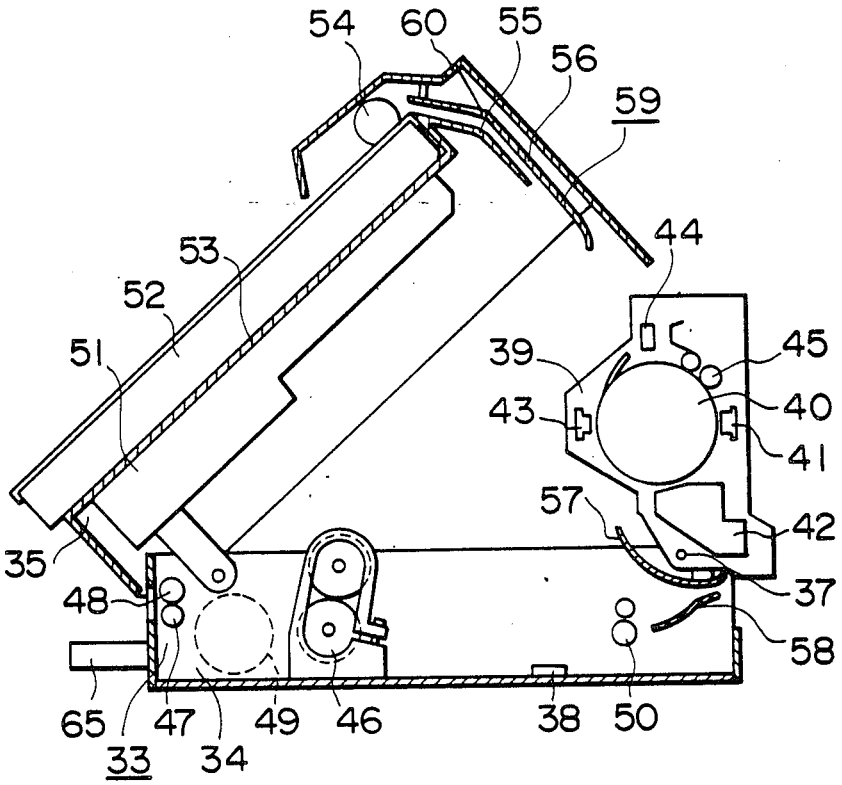
FIG. 6 is a vertical sectional side elevational view illustrating the device of FIG. 4 having a cover and a drum frame in open positions.
Figure 7:
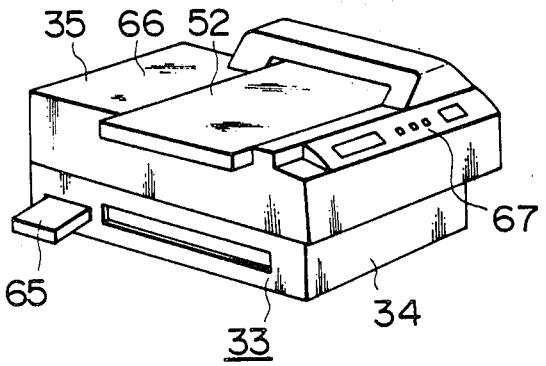
FIG. 7 is a perspective view, in a reduced scale, illustrating the entire printer.
Figure 8:
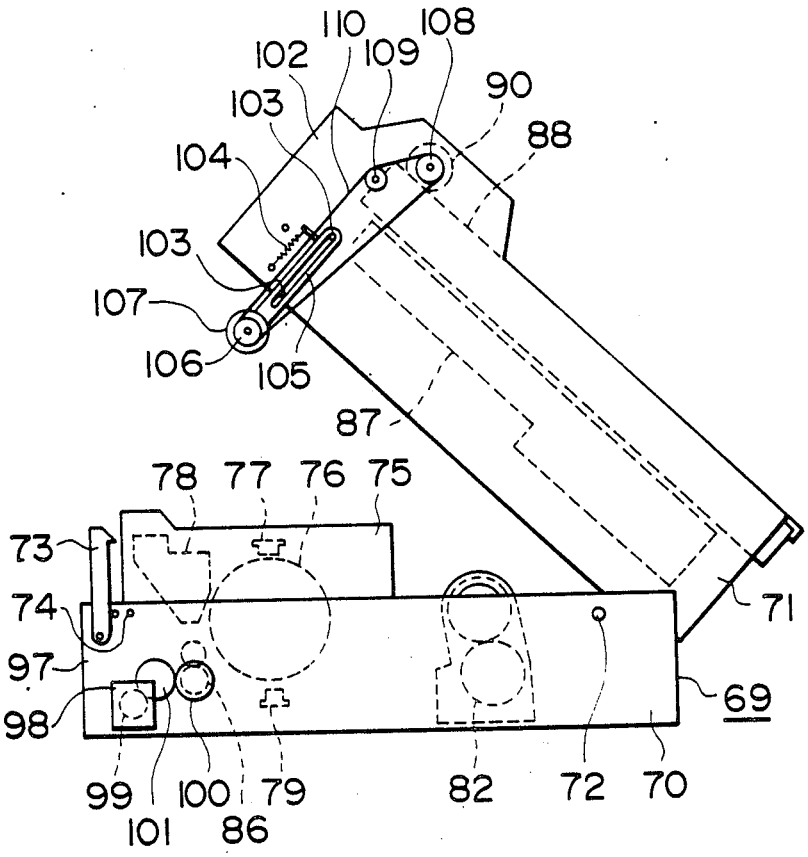
FIG. 8 is a rear elevational view illustrating a third embodiment of paper supply device for an electrostatic photographic printer according to the invention, with a cover held in an open position.
Figure 9:
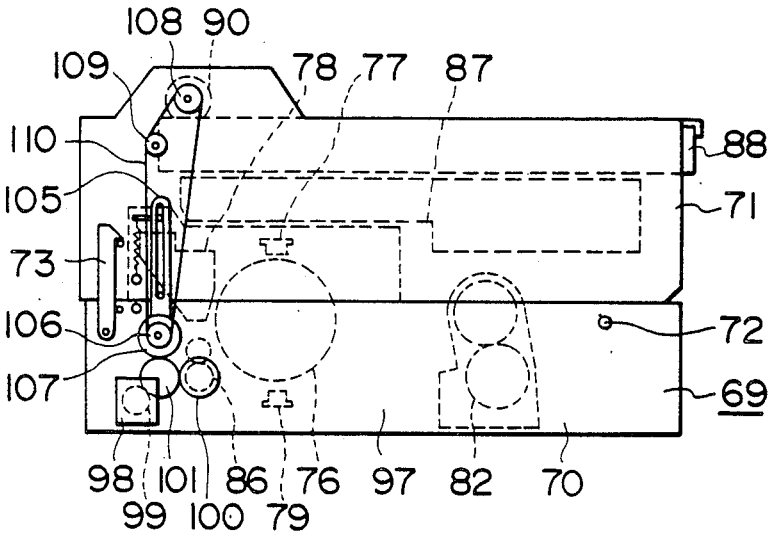
FIG. 9 is a rear elevational view illustrating the device with the cover held in a closed position.
Figure 10:
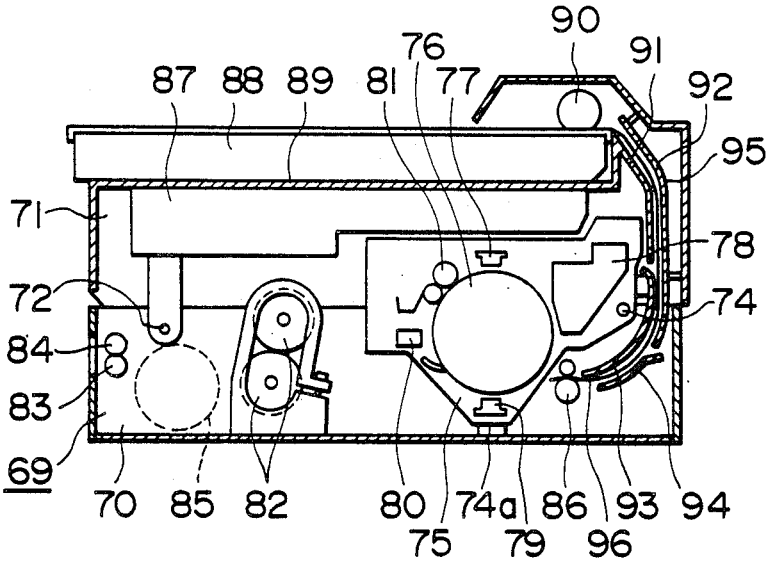
FIG. 10 is a vertical sectional front elevational view illustrating the device with the cover held in the closed position.
Figure 11:
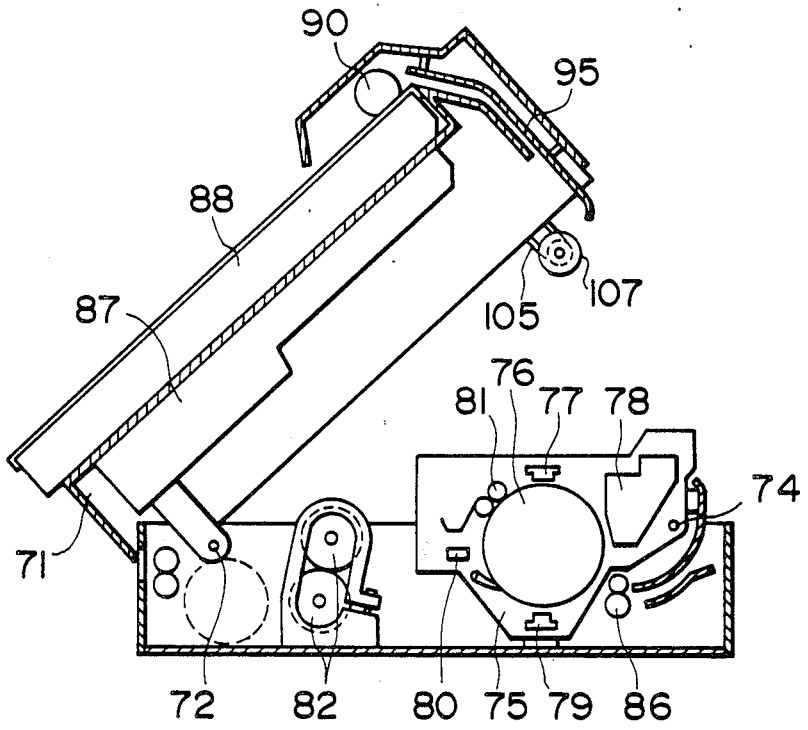
FIG. 11 is a vertical sectional front elevational view illustrating the device with the cover held in the open position.

Further, as shown in FIG. 5, the base 34 has provided in a rear part thereof power source means 62 and 62, control printed circuit boards 64 forming a controlling means contained in a casing 63, and an input printed circuit board 65 for a character generator.

The power source means 62 is adapted to generate a high voltage for the charging means 41. A lid portion 66 for covering the power source means 61 and 62 and the control printed circuit boards 64 is integrally formed at a rear part of the cover 35, and an operating section 67 is provided at a front part of the cover 35.

In the printer having such a construction as described above, as the photosensitive member 40 is rotated one complete rotation, a layer of charge is first formed on an outer periphery of the photosensitive member 40 by the charging means 41, and then a laser beam is scanned from the light source means 51 to the layer of charge to form an electrostatic latent image on the photosensitive member 40. Then, toner is supplied from the developing means 42 to the photosensitive member 40 to convert the electrostatic latent image into a visible toner image. Meanwhile, a sheet of paper 68 drawn out from the paper supply cassette 52 by the paper supply roller 54 is guided by the paper guide 59 and fed by the paper feeding means 50 to a position below the photosensitive member 40. At that position the visible toner image on the photosensitive member 40 is transferred to the sheet of paper 68 by the transfer means 43 and is then fixed thereto by the fixing roller 46. The sheet of paper 68 is finally discharged outside the printer by the discharging roller 47 and the pressure roller 48.

After transfer of the toner image, the electrostatic latent image remaining on the photosensitive member 40 is then exposed to and thus erased by light from the lamp 44. Thereafter toner remaining on the photosensitive member 40 is scraped off by the cleaning means 45.

Since the paper supply cassette 52 is provided on the top of the cover 35 in this way, the area required for installation of the printer can be reduced significantly. Besides, since the cover 35 can be pivotally opened around the pivot shaft 36, and since the drum frame 39 can also be pivotally opened around the pivot shaft 37, inspection and operation to release jamming can be effected easily. In addition, since the guide plate 56 normally opposed to the guide plate 57 is lifted when the cover 35 is opened, even if a sheet of paper 68 jams within the paper guide 59, it can be easily removed by partly opening the paper guide 59.

Moreover, since the power source means 61 and 62 and the control printed circuit boards 64 are covered with the lid portion 66 formed in integral relationship with the cover 35, there is not need of provision of a separate specific cover at a rear part of the cover, resulting in reduction of the number of parts.

It is to be noted that the drum frame 39 may be mounted for pivotal motion relative to the cover 35 in a fashion other than that depicted in the drawings. Further, the transfer means 43 may be mounted on the base 34 in a fashion other than that depicted in the drawings.

A third embodiment of the present invention will now be described in detail with reference to FIGS. 8 to 11. A housing 69 includes a base 70 in the form of a box which is open at the top thereof, and a cover 71 in the form of a box which is open at the bottom thereof and connected at an end thereof for pivotal motion to the base 70 by means of a pivot shaft 72. The cover 71 is removably connected at the other end thereof to the base 70 by means of a clamp 73. The base 70 has a drum frame 75 mounted for pivotal motion around a pivot shaft 74 thereon. The drum frame 75 is urged to pivot downwardly by its own weight to a position in which it is abutted against and positioned by a stop 74*a*.

A cylindrical photosensitive member 76 is supported for pivotal motion at a portion of the base 70 (that is, on the drum frame 75) and is connected to a motor (not shown). A charging means 77, a toner supplying means 78, a transfer means 79, a lamp 80, and a cleaning means 81 are located in order around an outer periphery of the photosensitive member 76. The base 70 has provided thereon a fixing roller 82 serving as a fixing means, a discharging roller 83, a pressure roller 84 contacted under pressure with he discharging roller 83, a motor 85 for driving the discharging roller 83 and the fixing roller 82, and a paper feed roller 86 serving as a paper feeding means.

A light source means 87 for illuminating a laser beam to the photosensitive member 76 to effect optical scanning is mounted on a rer face of a top wall of the cover 71, and a recess 89 for slidably holding a paper supply cassette 88 is formed in the cover 71 in an opposing relationship to the light source means 87. A paper supply roller 90 is located in the interior of the recess 89. The cover 71 has provided at a side portion thereof a guide plate 91 which depends from an end of the recess 89 and another guide plate 92 which is longer than the guide plate 91. The base 70 has provided thereon a further guide plate 93 which is held on the drum frame 75 in an opposing relationship to a lower part of the guide plate 92. A still further guide palte 94 is opposed to a lower part of the guide plate 93. Thus, the guide plates 91 to 94 cooperatively constitute a paper guide 95.

The base 70 has, at a rear part thereof, a side plate 97 on which are provided a motor 98, a motor gear wheel 99 directly connected to the motor 98, and a driving gear wheel 101 for transmitting rotation of the motor gear wheel 99 to a further gear wheel 100 secured to an end of the paper feed roller 86. The cover 71 has, at a rear part thereof, a side plate 102 on which a movable member 105 is mounted for sliding motion by means of a guide pin 103 extending from the side palte 102 of the cover 71. The movable member 105 is urged downwardly by a spring 104 and has a pulley 106 and a follower gear wheel 107 mounted at a lower end thereof. The pulley 106 and the follower gear 107 are connected to each other for integral rotation. The side plate 102 of the cover 71 further has provided thereon a pulley 108 which is connected to the paper supply roller 90 and a tension pulley 109. A timing belt 110 extends between and around the pulleys 106 and 108 and the tension pulley 109.

In the printer having such a construction as described above, if the cover 71 is pivoted downwardly and is fixed by the clamp 73, when the follower gear wheel 107 is meshed with the driving gear wheel 101. Accordingly, if the motor 98 is energized, then the paper feed roller 86 and the paper supply roller 90 are rotated thereby. Thus, as the photosensitive member 76 is rotated one complete rotation, a layer of charge is first formed on an outer periphery of the photosensitive member 76 by the charging means 77, and then a laser beam is scanned from the light source means 87 to the layer of charge to form an electrostatic latent image on the photosensitive member 76. The, tone is supplied from the toner supplying means 78 to the photosensitive member 76 to convert the electrostatic latent image into a visible toner image. Meanwhile, a sheet of paper 96 drawn out from the paper supply cassette 88 by the paper supply roller 90 is guided by the paper guide 95 and fed by the paper feed roller 86 to a position below the photosensitive member 76. At that position the visible tone image on the photosensitive member 76 is transferred to the sheet of paper 96 by the transfer means 79 and is then fixed thereto by the fixing roller 82. The sheet of paper 96 is finally discharged outside the printer by the discharging roller 83 and the pressure roller 84.

After transfer of the toner image, the electrostatic latent image remaining on the photosensitive member 76 is then exposed to and thus erased by light from the lamp 80. Thereafter toner remaining on the photosensitive member 76 is scraped off by the cleaning means 81.

Since the paper supply cassette 88 is provided on the top of the cover 71 in this way, the area required for installation of the printer can be reduced significantly. Besides, since the cover 71 can be pivotally opened around the pivot shaft 72 and since the frame 75 can also be pivotally opened around the pivot shaft 74, inspection and operation to release jamming can be effected easily.

Moreover, since the movable member 105 can resiliently move upwardly when the cover 71 is pivoted downwardly to bring the follower gear wheel 107 into meshing engagement with the driving gear wheel 101, possible shocking upon such meshing engagement can be absorbed thereby. Hence the tolerance of the range of pivotal motion of the cover 71 can be set relatively wide, resulting in facilitation of production of the device. In addition, there is no need of mounting the motor for driving the paper supply roller 90 on the cover 71, which is mounted for opening and closing operation, and hence the weight of the cover 71 can be reduced.

We claim:

1. An electrostatic photographic printer comprising:

(a) a housing, said housing including a base and a cover which are connected for pivotal motion in a vertical plane relative to each other;

(b) a picture image forming means provided at a lower part of said housing, said picture image forming means including at least one photosensitive member on which an electrostatic latent image is to be formed, a toner supplying means, a transfer means, and a fixing means;

(c) a paper supply cassette provided at an upper part of said cover;

(d) a paper supply roller provided at said upper part of said cover for rotation to draw out individual sheets of paper disposed in said paper supply cassette;

(e) a driving means connected to drive said paper supply roller; and (f) a paper guide for guiding paper from said paper supply roller to said picture image forming means, said paper guide including a first guide plate provided along an inner face of said base and a second guide plate provided along an inner face of said cover in an opposing relationship to said first guide plate, said first and second guide plates being sized, shaped, and positioned so that, when said cover is pivoted away from said base, said second guide plate is widely separated from said first guide plate, facilitating the removal of jammed paper.

2. An electrostatic photographic printer as recited in claim 1 and further comprising (a) an engaging member mounted for displacement at said upper part of said cover and (b) means for urging said engaging member in a direction to resiliently engage with said paper supply cassette.

3. An electrostatic photographic printer as recited in claim 2 and further comprising a switch mounted on said cover for operation in response to operation of said engaging member.

4. An electrostatic photographic printer comprising:

(a) a housing, said housing including a base and a cover which ar connected for pivotal motion in an vertical plane relative to each other;

(b) a picture image forming means provided at a lower part of said housing, said picture image forming means including at least one photosentive member on which an electrostatic latent image is to be formed, a toner supplying means, a transfer means, and a fixing means;

(c) a paper supply cassette provided at said upper part of said cover;

(d) a paper supply roller provided at said upper part of said cover for rotation to draw out individual sheets of paper disposed in said paper supply cassette;

(e) a driving means connected to drive said supply roller;

(f) a paper feed roller mounted on said base for transporting a sheet of paper drawn out by said paper supply roller to said transfer means;

(g) a motor mounted on said base connected to said paper feed roller;

(h) a driving gear wheel mounted on said base and connected to said motor; and (i) a follower gear wheel mounted on said cover and connected to said paper supply roller, said follower gear wheel being positioned for releasable meshing engagement with said driving gear wheel.

5. An electrostatic photographic printer as recited in claim 4 and further comprising:

(a) a movable member mounted for sliding movement on said cover and urged in a downward direction and (b) a pulley mounted at a lower part of said movable member and connected to said paper supply roller by means of a belt, said pulley being connected for integral rotation around a common axis with said follower gear wheel.

* * * * *